US006861935B1

(12) United States Patent
Leupold

(10) Patent No.: US 6,861,935 B1
(45) Date of Patent: Mar. 1, 2005

(54) FIELD TAPERING IN MAGNETIC SPHERES AND CYLINDERS WITH DISTORTION FREE ACCESS

(75) Inventor: Herbert A. Leupold, Eatontown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/914,786

(22) Filed: Aug. 4, 2004

(51) Int. Cl.[7] ..... H01F 7/02
(52) U.S. Cl. ..... 335/306
(58) Field of Search ..... 335/210–214, 335/301–306; 315/5.34, 5.35; 372/2

(56) References Cited

U.S. PATENT DOCUMENTS

| | | | | |
|---|---|---|---|---|
| 4,837,542 A | | 6/1989 | Leupold | |
| 4,839,059 A | | 6/1989 | Leupold | |
| 5,103,200 A | | 4/1992 | Leupold | |
| 5,216,400 A | | 6/1993 | Leupold | |
| 5,216,401 A | | 6/1993 | Leupold | |
| 5,382,936 A | | 1/1995 | Leupold et al. | |
| 5,396,209 A | * | 3/1995 | Leupold | 335/306 |
| 5,426,338 A | | 6/1995 | Leupold | |
| 5,434,462 A | | 7/1995 | Leupold et al. | |
| 5,523,731 A | | 6/1996 | Leupold | |
| 6,396,378 B1 | * | 5/2002 | Leupold | 335/306 |

OTHER PUBLICATIONS

Leupold et al., "An Overview of Modern Permanent Magnet Design", U.S. Army T.R. SLCET–TR–90–6, Aug. 1990.

Leupold et al., "A Permanent Magnet Circuit Design Primer", U.S. Army T.R. ARL–TR–946, Jul. 1996.

Leupold et al., "Impact of the High–Energy Product Materials on Magnetic Circuit Design", Mat.Res. Soc.Symp. Proc., vol. 96, pp. 279–306, 1987 Materials Research Society.

* cited by examiner

*Primary Examiner*—Ramon M. Barrera
(74) *Attorney, Agent, or Firm*—Michael Zelenka; Roger C. Phillips

(57) ABSTRACT

A permanent magnet comprises a shell surrounding a cavity. The shell has a magnetic remanence $B_r(\theta)$ configured such that a magnetic field taper extends through the cavity and wherein the shell includes a non-distortive access region that is substantially magnetic field.

26 Claims, 7 Drawing Sheets

FIELD TAPERING IN MAGNETIC SPHERES AND CYLINDERS WITH DISTORTION FREE ACCESS

GOVERNMENT INTEREST

The invention described herein may be manufactured, used, imported, sold, and licensed by or for the Government of the United States of America without the payment of any royalty thereon or therefor.

BACKGROUND OF THE INVENTION

1. Field of the Invention

The present invention relates generally to permanent magnets and, more particularly, to high intensity permanent magnets having gradient fields and to methods of making such magnets.

2. Related Art

Permanent magnets that are capable of producing high intensity magnetic fields and that have a compact structure are known and are used, e.g., in miniaturized electrical components including disk drives for laptop and palmtop computers. In particular, permanent magnet materials that are highly remanent and coercive, such as those of the rare earth type, are produced to make compact flux sources of extraordinary strength. Examples of high-intensity, compact permanent magnets, which may employ these materials, may be found in the following patents. U.S. Pat. No. 4,837,542, to Leupold, entitled "Hollow Substantially Hemispherical Permanent Magnet High Field Flux Source for Producing a Uniform High Field"; U.S. Pat. No. 4,839,059 to Leupold, entitled "Clad Magic Ring Wigglers"; U.S. Pat. No. 5,103,200 to Leupold, entitled "High-Field Permanent Magnet Flux Source"; U.S. Pat. No. 5,216,401 to Leupold, entitled "Magnetic Field Sources Having Non-Distorting Access Ports"; U.S. Pat. No. 5,382,936 to Leupold et al., entitled "Field Augmented Permanent Magnet Structures"; U.S. Pat. No. 5,426,338 to Leupold, entitled "High-Power Electrical Machinery with Toroidal Permanent Magnets"; U.S. Pat. No. 5,434,462 to Leupold et al., entitled "High-Power Electrical Machinery"; and U.S. Pat. No. 5,523,731 to Leupold, entitled "Simplified Method of Making Light Weight Magnetic Field Sources Having Distortion-Free Access Ports. The entire contents of each of the foregoing patents is hereby incorporated herein by reference to the extent necessary to make and practice the present invention.

The basic configuration from which the magnetic arrangements described above are derived may be referred to as a Halboch Structure or a magic cylinder or ring. The magic ring is a permanent magnet which is magnetized in accordance with the configuration shown in FIG. 1. The orientation of magnetization at any point (P) is at an angle ($\gamma$) from a vertical axis (z) and is equal to twice the polar coordinate of P,($\theta$) or according to equation (1) as follows:

$$\gamma=(2)(\theta) \tag{1}$$

where:

($\theta$) is a polar angle between the x and z axes that may vary from $\theta=0°$ to $\theta=\pm 0°$ as shown.

Such a magnetization pattern produces in an internal cavity (c) a uniform magnetic field (represented by arrow h). Ideally the change in direction of magnetization should be continuous but this is not technically feasible. Instead an approximation to the ideal magic ring structure can be formed by a method as described in U.S. Pat. No. 5,523,731, previously incorporated herein by reference. The method may comprise uniformly magnetizing a cylindrical shell along a plane defined by radii of the shell and cutting the shell into thin washer shaped pieces. Each of the washer-shaped pieces may then be cut in a radial manner to form truncated pie shaped pieces that may be then reversed 180° (turned upside down) and transposed to proper locations along the circumference of the ring to form a thin magic ring slice having the magnetization approximately as shown in FIG. 1. The formation of a magic cylinder may be accomplished by stacking the magic rings together in an elongated fashion. It will be recognized that the ideal structure can be approached as closely as desired by increasing the number of truncated pie shaped pieces per magic ring.

It may be desired in particular applications employing magic rings or cylinders that access ports of various sizes, shapes and locations extend through the shell and communicate with the internal cavity (c). However, removal of magnetic material to provide an access port to the interior through the magnetic shell will distort the interior field especially in the vicinity of the port. To overcome this drawback, a further method is proposed, as also described in U.S. Pat. No. 5,523,731, wherein some of the thin washer-shaped pieces that are sliced from the uniformly magnetized cylinder are interleaved with the magic ring slices to form a cylinder that allows for non-distorting access ports. In such a case, removal of magnetic material results in a non-distorting access port, since a uniformly magnetized ring produces no field in its interior cavity and superposition of such a magnetization pattern upon that of ae magic ring would result in no change in the field located in the cavity of the magic ring.

It is also sometimes desired to produce permanent magnets having a shell and a cavity wherethrough a high intensity magnetic field extends which is tapered, or has a gradient. For example, electron-beam tubes often require gradient fields, which typically vary along a beam axis, for use in focusing and guiding the beam. Microwave and millimeter wave sources require an axial field variation of a longitudinal magnetic field in order to produce a crisp waveform and storage rings and particle accelerators may require transverse magnetic fields including field tapering in the direction of a longitudinal axis of a beam in order to compensate for changes in a velocity of the beam. In spectroscopic analysis, magnetic fields with a linear taper in the direction of the field are often used to produce a spectral distribution of absorbed or emitted electromagnetic energy.

U.S. Pat. No. 5,216,400 to Leupold (below referred to as the "400 Patent"), the entire contents of which is hereby incorporated herein by reference to the extent necessary to make and practice the present invention, describes a permanent magnet having a cavity and producing a magnetic field that varies in intensity and in the direction of its orientation to produce a tapered or gradient magnetic field within a cavity thereof. As generally described therein, to provide a linear taper along the z axis of a magnetic ring or cylinder where the south pole is at z=0 at an inner edge of a cavity, the remanence is tapered along the polar angle $\theta$ according to equation (2) as follows:

$$B_r(\theta)=m\theta+B_r^{Min}(0°) \tag{2}$$

where:

$B_r(\theta)$ is the desired magnet remanence at $\theta$;

$B_r^{Min}$ is the minimum remanence appropriate to produce a field H(Min) at the low end of the taper located in the cavity of the magnetic ring or cylinder and H(Max) being the field at the high end of the taper; and where m is found according to equation (3) as follows:

$$m=[B_r^{Max}(90°)-B_r^{Min}(0°)]/\pi \quad (3)$$

where:

$B_r^{Max}$ is the maximum remanence at $z=d_l$ at the north pole of the cavity and $d_i$ is the diameter of the cavity.

The permanent magnets described in the above patents and documents have numerous applications and advantages, however, it is desired to provide a permanent magnet including a cavity having both a gradient magnetic field and a distortion free access port.

SUMMARY OF THE INVENTION

In accordance with an embodiment of the present invention, a permanent magnet comprises a shell surrounding a cavity. The shell comprises a magnetic remanence $B_r(\theta)$ configured such that a magnetic field taper extends through the cavity and wherein the shell also comprises a non-distortive access region that is substantially absent any magnetic field.

Another aspect of the present invention concerns a permanent magnet that comprises a shell surrounding a cavity and wherein the shell comprises a magnetic remanence configured whereby a magnetic field taper extends through the cavity. The remanence $B_r(\theta)$ of the shell varying according to the formula:

$$B_r(\theta)=[(B_r^X(\theta))^2+(B_r^Z(\theta))^2]^{1/2}$$

where:

$B_r^X(\theta)=\{[(B_r^{Max}-B_r^{Min})/90°](\theta)-B_r^{Min}\}\cos(90°-2\theta)$;

$B_r^Z(\theta)=\{[(B_r^{Max}-B_r^{Min})/90°](\theta)-B_r^{Min}\}\sin(90°-2\theta)+(B_r^{Max}+B_r^{Min})/2$;

$(\theta)$ is a polar angle between $\theta=0°$ to $\theta=\pm180°$;

$B_r^{Max}$ is a maximum remanence desired; and $B_r^{Min}$ is equal to a minimum remanence appropriate to produce a minimum magnetic field H(Min) of the magnetic field taper. The shell also comprises a pair of opposing non-distortive access regions substantially absent any magnetic field.

A further aspect involves a method of making a permanent magnet having a cavity, comprising providing at least one first segment having a first magnetic field that has a single predetermined direction of magnetization and that has a uniform first remanence; providing at least one second segment having a second magnetic field that has a direction of magnetization ($\gamma$) that varies circumferentially along the segment according to the formula $\gamma=(2)(\theta)$ where $\theta$ is a polar angle from $\theta=0°$ to $\theta=360°$ and wherein the second magnetic field comprises a second remanence which increases in magnitude from $\theta=0°$ to $\theta=180°$ and decreases in magnitude from $\theta=180°$ to $\theta=360°$; and combining the at least one first segment and the at least one second segment to form a permanent magnet.

BRIEF DESCRIPTION OF THE DRAWINGS

The following detailed description is made with reference to the accompanying drawings, in which.

DETAILED DESCRIPTION OF THE PREFERRED EMBODIMENT

One embodiment of the present invention concerns a permanent magnet that has both a cavity comprising a gradient magnetic field and a distortion free access port. In another embodiment of the invention, a permanent magnet may comprise a plurality of first and second segments that may be easily assembled together to provide the desired magnetic field parameters.

Figure 1:
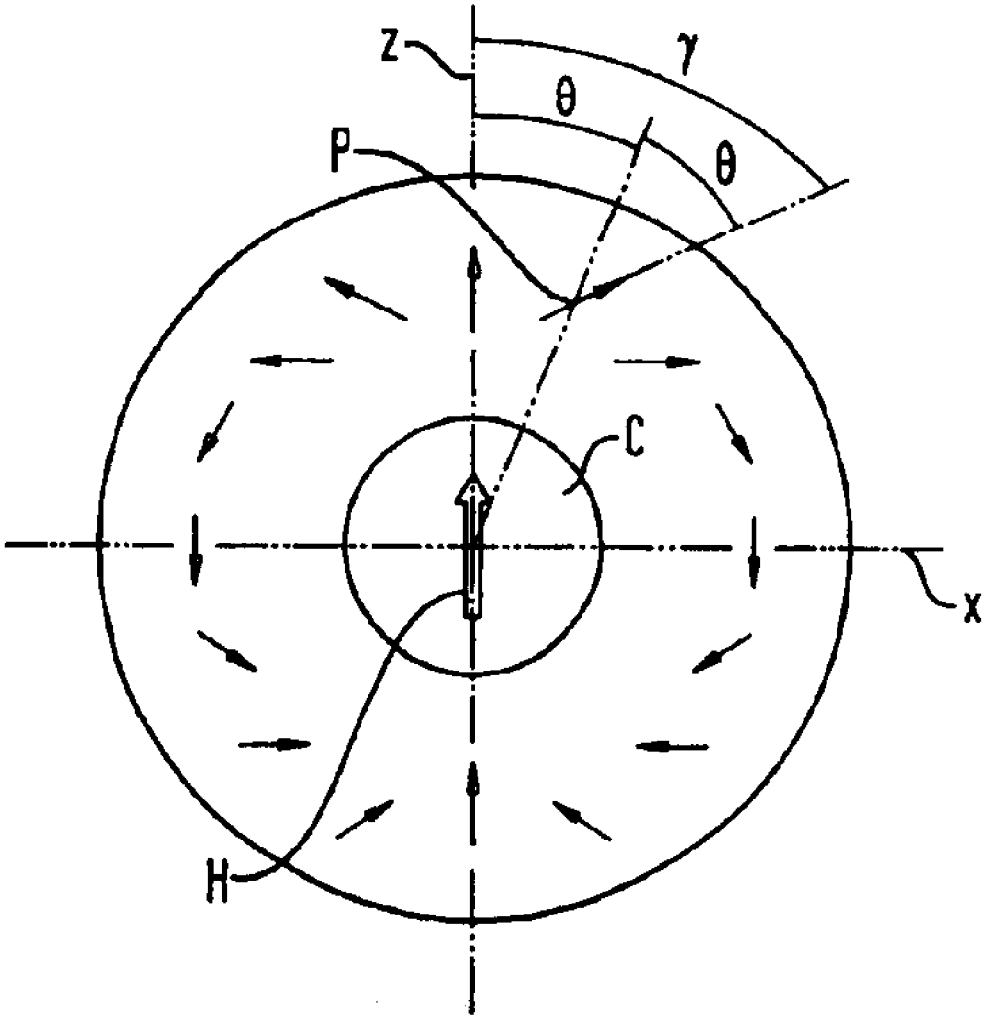
FIG. 1 (PRIOR ART)
FIG. 1 is diagram showing a magnetic ring in accordance with the prior art.
Figure 2:
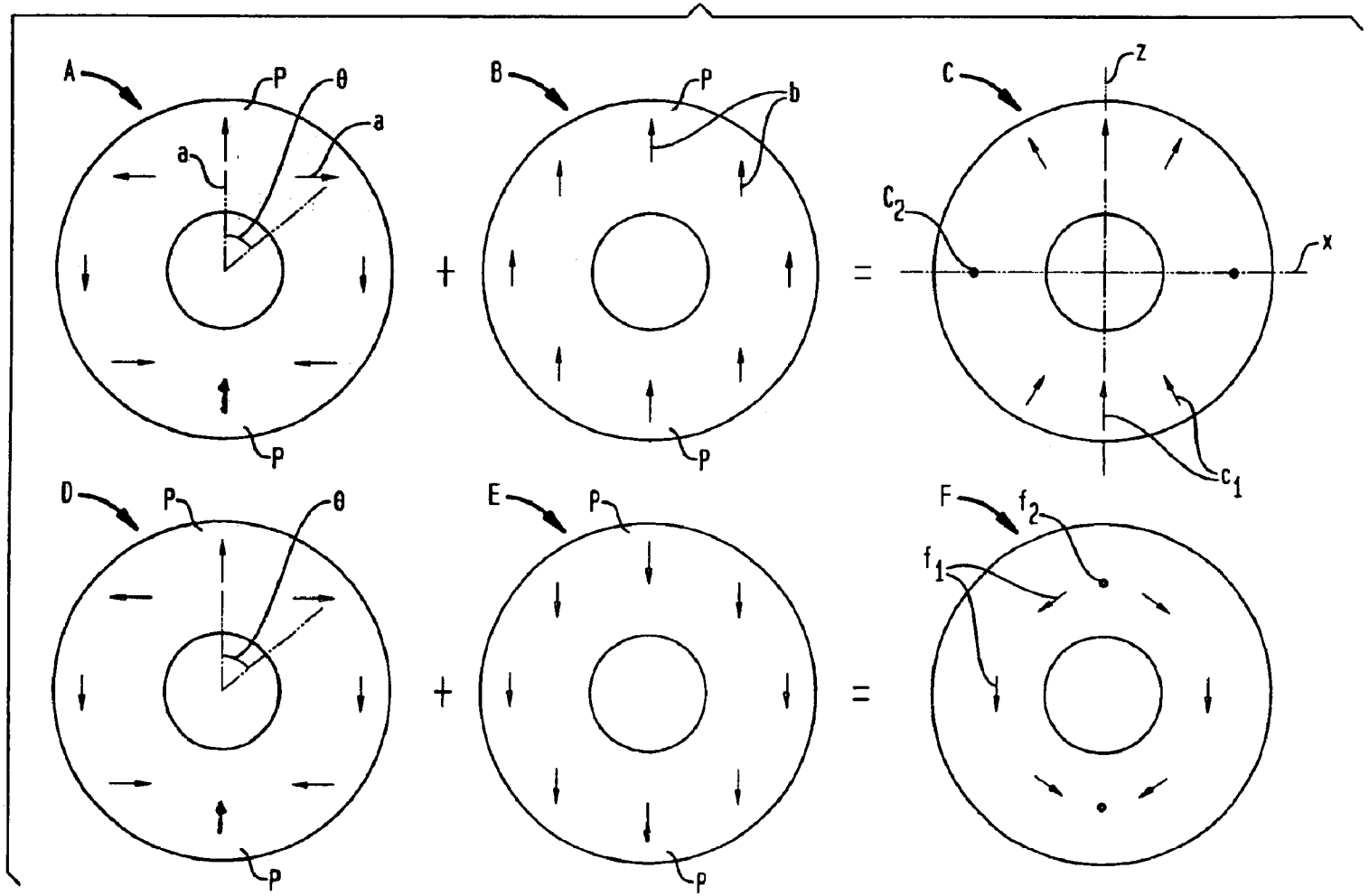
FIG. 2 is a series of diagrams showing how magnetic fields of magnetic rings may be combined in accordance with an embodiment of the present invention.

Referring to FIG. 2, and in accordance with an embodiment of the present invention, a combination of magnetic rings, each having a particular magnetization, may be combined to form a magnetic ring having a particular resultant magnetization, the particulars of which may be found by vector analysis. For example, a first magnetic ring A including a magnetization direction and magnitude represented by arrows a may be combined with a magnetic ring B including a magnetization represented by arrows b (of equal magnitude to those of arrows a and in tandem at poles p where $\theta=0°$ and $\theta=180°$) to form a magnetic ring C that has a resulting field reflected in arrows $c_1$ and voids or nulls in points $c_2$, located at $\theta=\pm90°$. It will be understood that since a magnetization of zero is present at the nulls, represented at points $c_2$, material may be removed from the magnetic ring C at points $c_2$ in order to provide non-distortive access ports as described in more detail below. Within the magnetic ring C the magnetization (M) components vary in the x and z directions according to the following equations (4) and (5):

$$M_x=M_0\sin(2\theta); \quad (4)$$

$$M_z=M_0(\cos2\theta+1); \quad (5)$$

where:

$M_0$ is the magnetization of the material used and is equal to the remanence ($B_r$) divided by $4\pi$ ($M_0=B_r/4\pi$). It will be recognized that where a desired $B_r$ exceeds that of the best available material, an increase in the radius of the ring may be used to compensate for this.

In another example, by combining magnetic ring D including magnetization represented by arrows d with magnetic ring E including a magnetization represented by arrows e (of equal magnitude to those of arrows e and in opposition at poles p), a magnetic ring F is formed with a resulting field reflected in arrows $f_1$ and voids in points $f_2$, located at θ=0° and 180°. Accordingly, material may be removed from the magnetic ring F and non-distortive access ports may be provided at points $f_2$. Within the magnetic ring C the magnetization (M) components vary in the x and z directions according to the following equations (6) and (7):

$$M_x=M_0\cos(2\theta); \quad (6)$$

$$M_z=M_0(\sin\theta+1). \quad (7)$$

Figure 3:
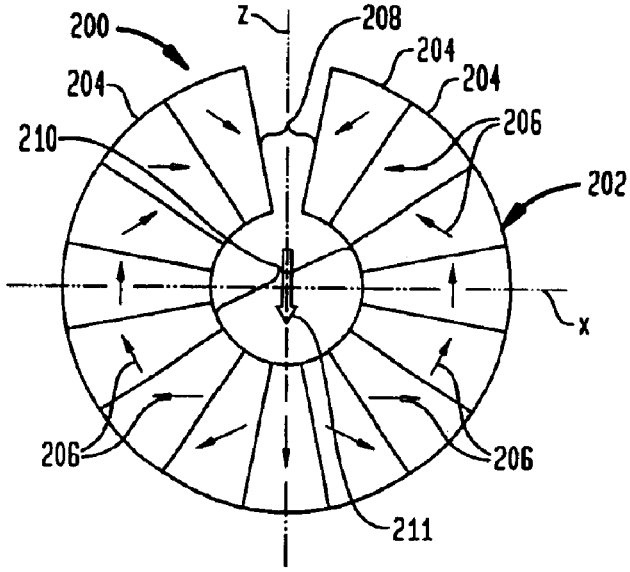
FIG. 3 is a top view of a cylindrical permanent magnet showing various directions of magnetization in accordance with an embodiment of the present invention.

Referring now to FIG. 3, a cylindrical permanent magnet having both-a gradient magnetic field in a cavity thereof and a distortion free access port in accordance with an embodiment of the present invention is shown generally at 200. The permanent magnet 200 may comprise a shell 202 and a plurality of sections 204. Each section 204 may be magnetized, as described in more detail below, such that both a direction of magnetization and a magnitude of magnetization may vary section by section. This is represented by the direction and length of arrows 206.

Further in accordance with this embodiment, a non-distortive access region or notch 208 is provided for access to a cavity 210. Also, a gradient magnetic field, represented by arrow 211, resides within the cavity 210.

Figure 4:
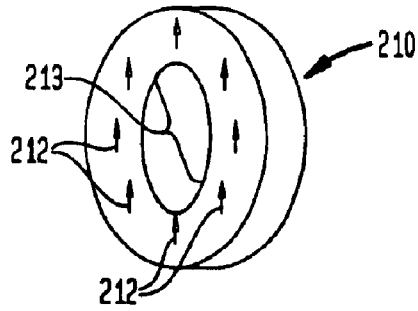
FIG. 4 is a perspective view of a magnetic ring having a uniform magnetic field.
Figure 5:
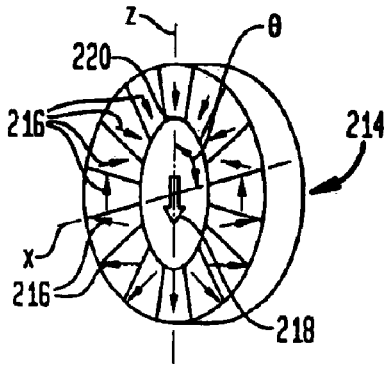
FIG. 5 is a perspective view of a magnetic ring having a magnitude and direction of magnetization that varies with a change in polar angle.

It has been found that when a magnetization of two separate magnetic rings or cylinders, such as those illustrated in FIGS. 4 and 5, are combined, a magnetization that results is consistent with the magnetization represented by the arrows 206 of the permanent magnet 200 of FIG. 3.

Referring now also to FIG. 4, a magnetic ring 210 may be magnetized by a uniform magnetic field to form a uniform remanence ($B_{r1}$) as represented by the direction and length of arrows 212. As is evident to one of ordinary skill in the art, generally no magnetic field is present within a cavity 213 of the magnetic ring 210.

Referring now further to FIG. 5, a magnetic ring 214, which may be similar to that described in U.S. Pat. No. 5,216,400, above incorporated herein by reference, is shown which may be magnetized such that the direction of magnetization (γ) varies circumferentially along the segment according to the equation (8) as follows:

$$\gamma=(2)(\theta) \quad (8)$$

where:

(θ) is a polar angle between the x and z axes that may vary from θ=0° to θ=±180° as shown.

Arrows 216 are oriented in a manner to illustrate the direction of magnetization (γ) which varies about the circumference of the magnetic ring 214. Arrows 216 also illustrate the magnitude of a remanence ($B_{r2}$) which also varies about the circumference of the magnetic ring 214. In particular, the remanence ($B_{r2}$) generally increases from θ=0° to θ=180° and decreases from θ=180° to θ=0°. More specifically, the remanence ($B_{r2}$) varies according to equation (9) as follows:

$$B_{r2}(\theta)=m\theta+B_r^{Min} \quad (9)$$

where:

θis a polar angle from θ=0° to θ=±180°; and m varies according to equation (10) as follows:

$$m=(B_r^{Max}-B_r^{Min})/90° \quad (10)$$

where:

$B_r^{Max}$ is the maximum remanence required to generate a maximum H(Max) magnetic field strength at the high end of a resulting tapered or gradient field represented by arrow 218 which is located within a cavity 220 of the magnetic ring 214; and $B_r^{Min}$ is equal to the minimum remanence appropriate to produce a magnetic field H(Min) at the low end of a resulting tapered or gradient field represented by arrow 218. $B_r^{Min}$ is also equal to $B_{r1}$ of the magnetic ring 210.

Combining the uniform magnetization of the magnetic ring 210 with the varying magnetization arrangement of the magnetic ring 214 results in a varying magnetization such as that of the permanent magnet 200 of FIG. 3. Since generally no magnetic field is present in the cavity 213 of the magnetic ring 210, combining magnetic rings 210 and 214 results in no change to the tapered or gradient magnetic field of the magnetic ring 214 and thus is represented in the magnetic ring 200 by arrow 211. Also since the remanences ($B_{r1}$) and ($B_{r2}$) are equal but opposite in direction where θ=0°, a non-distortive access region exists at θ=0° and notch 208 may be provided. Further, the direction of magnetization (γ), illustrated by the direction of arrows 206, may be found in accordance with vector analysis as exemplified above in connection with FIG. 2.

In accordance with vector analysis, the resulting remanence in the permanent magnet 200 for θ=0° to θ=±180° for each vector component of the remanence along the x direction may be found from equation (6) as follows:

$$B_r^X(\theta)=\{[(B_r^{Max}-B_r^{Min})/90°](\theta)-B_r^{Min}\}^{cos}(90°-2\theta) \quad (11)$$

Each vector component of the resulting remanence along the z direction for θ=0° to θ=±180° may be found from equation (12) as follows:

$$B_r^Z(\theta)=\{[(B_r^{Max}-B_r^{Min})/90°](\theta)-B_r^{Min}\}\sin(90°-2\theta)-B_r^{Min} \quad (12)$$

The vector components $B_r^X(\theta)$ and $B_r^Z(\theta)$ may be combined to form a resultant remanence via equation (13) as follows:

$$B_r(\theta)=[(B_r^X(\theta))^2+(B_r^Z(\theta))^2]^{1/2} \quad (13)$$

The direction of magnetization (γ) for each of $B_r(\theta)$ may be found in accordance with equation (14) as follows:

$$\tan(\gamma)=B_r^Z/B_r^X \quad (14)$$

It will also be appreciated that the particular location (θ) of the notch 208 (or slot in the case of a cylinder) may be varied depending upon a desired location for distortion free access. For example, distortion free access may be provided in the permanent magnet 200 at θ=90° and at θ=270° by modifying the uniform remanence ($B_{r1}$) of the magnetic ring 210 to equal $(B_r^{Max}+B_r^{Min})/2$ whereby the following equations (15) and (16) for vector components of the remanence are obtained.

$$B_r^X(\theta)=\{[(B_r^{Max}-B_r^{Min})/90°](\theta)-B_r^{Min}\}\cos(90°-2\theta) \quad (15)$$

$$B_r^Z(\theta)=[((B_r^{Max}-B_r^{Min})/90°)(\theta)-B_r^{Min}]\sin(90°-2\theta)+(B_r^{Max}+B_r^{Min})/2 \quad (16)$$

The vector components $B_r^X(\theta)$ and $B_r^Z(\theta)$ may be combined to form a resultant remanence via equations (13) and (14) above.

It will be appreciated that the above-described equations may be used in connection with a sphere, although, the resulting distortion free access ports are cylindrical tunnels at the poles and an equatorial slot at the equator.

Optional Embodiment For Simple Assembly

Figure 6:
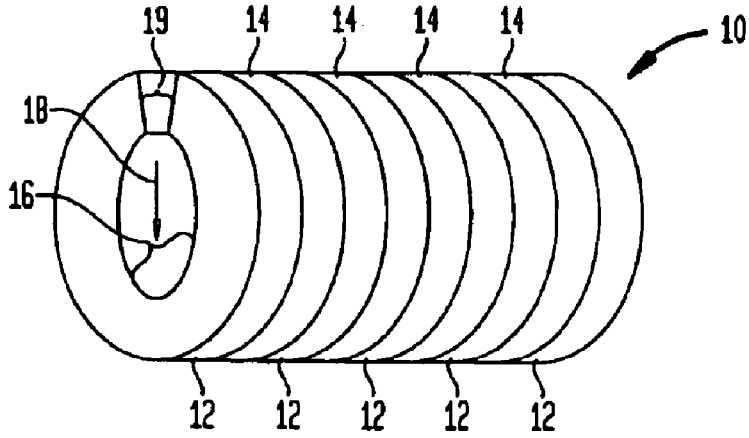
FIG. 6 is a perspective view of a cylindrical permanent magnet in accordance with an embodiment of the present invention.

Referring now to FIG. 6, a permanent magnet, in accordance with another embodiment of the present invention, is illustrated generally at 10. In this embodiment, the permanent magnet 10 comprises a plurality of segments 12, 14 each having an aperture 16. As illustrated, each of the segments 12, 14 are magnetized, as described in more detail below, and may be concatenated together to create a magnetic field within the apertures 16 which is tapered or increases in strength in the direction of the arrow 18 and which comprises a non-distortive access region or notch 19.

Figure 7:
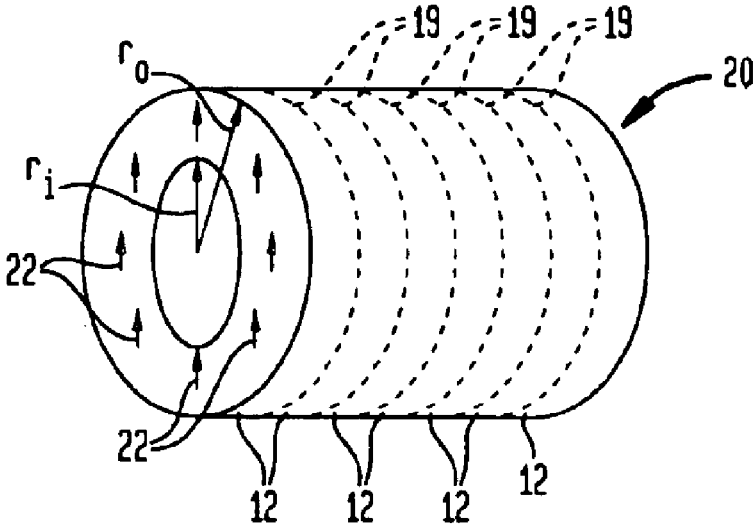
FIG. 7 is a perspective view of a first cylindrical blank magnetized with a uniform magnetic field and comprising a plurality of washer-shaped pieces.

The segments 12, or washer-shaped pieces and shown also in FIG. 7, may be cut (illustrated by dashed lines 19) from a cylindrical blank 20 that may comprise any suitable material capable of high remanence and thereby producing a high strength magnetic field such as a composition that includes a rare earth element. The cylindrical blank 20 may be magnetized by a uniform magnetic field to form a uniform remanence ($B_{r1}$) as represented by the direction and length of arrows 22.

Figure 8:
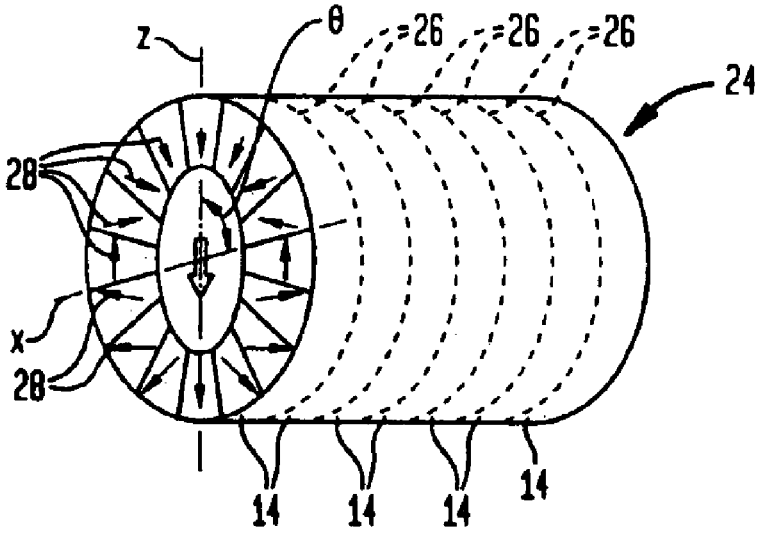
FIG. 8 is a perspective view of a second cylindrical blank having a magnitude and direction of magnetization that varies with a change in polar angle and that comprises a plurality of magnetic ring slices.

Referring to FIG. 8, a cylindrical blank 24 is shown from which segments 14, or magnetic ring slices, may be cut (as illustrated by dashed lines 26). The cylindrical blank 24 may comprise a similar material to that of the cylindrical blank 20, although, it will be appreciated that other materials capable of high remanence may be employed. The cylindrical blank 24 may be magnetized such that the direction of magnetization ($\gamma$) varies circumferentially along the segment similar to that described above in connection with FIG. 5 and according to the equations (9) and (10) above. Accordingly, arrows 28 are oriented in a manner to illustrate the direction of magnetization that varies about the circumference of the cylindrical blank 24. Arrows 28 also illustrate the magnitude of the remanence ($B_{r2}$) which also generally increases from $\theta=0°$ to $\theta=180°$ and decreases from $\theta=180°$ to $\theta=360°$ as described above.

Figure 9:
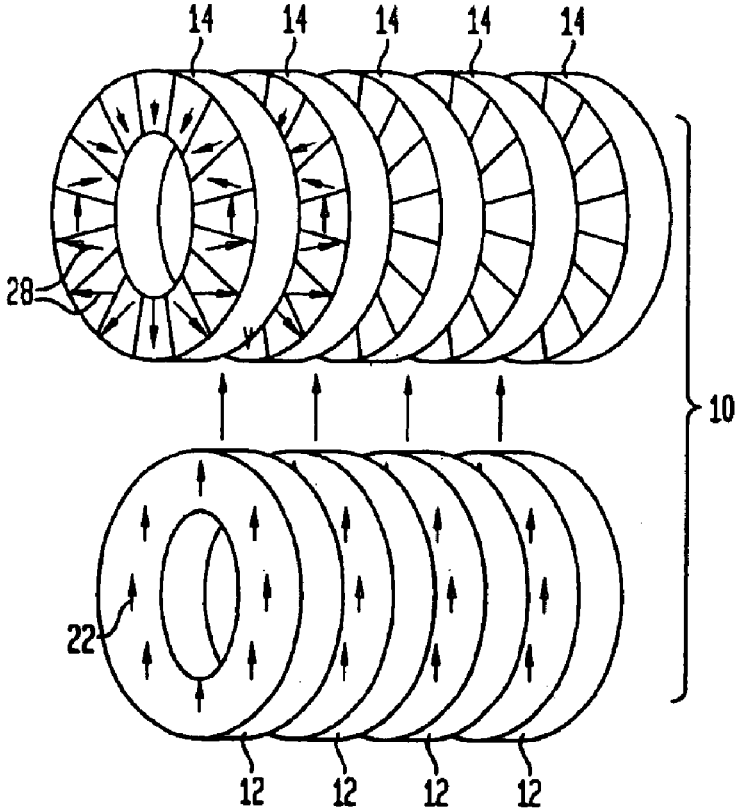
FIG. 9 is an exploded view showing assembly of the first segments of FIG. 7 and the second segments of FIG. 8 to form the cylindrical permanent magnet of FIG. 6.

FIG. 9 illustrates assembly of the permanent magnet 10, whereby segments 12 and 14 are interleaved together to form an elongated structure. It will be appreciated that the permanent magnet 10 may comprise a notch 30 (FIG. 5) which may be formed prior to or after assembly of the segments 12 and 14.

Figure 10:
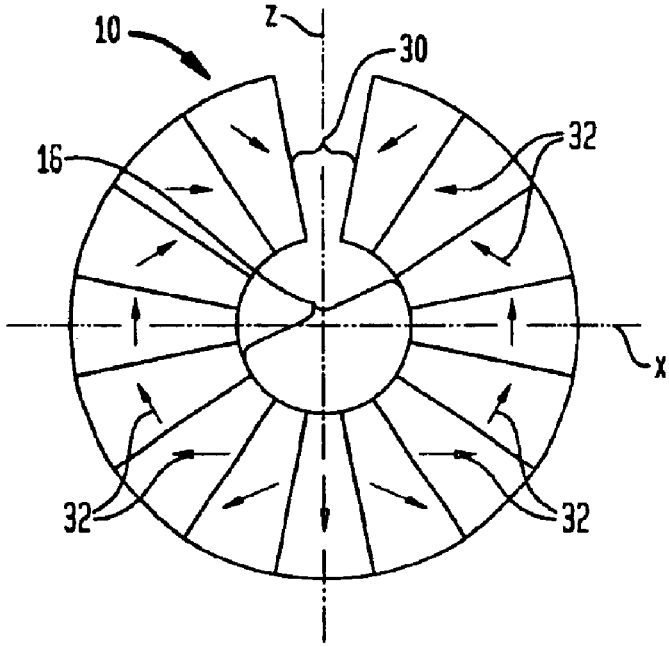
FIG. 10 is an end view of the cylindrical permanent magnet of FIG. 6 showing the various magnitudes and directions of magnetization.
Figure 11:
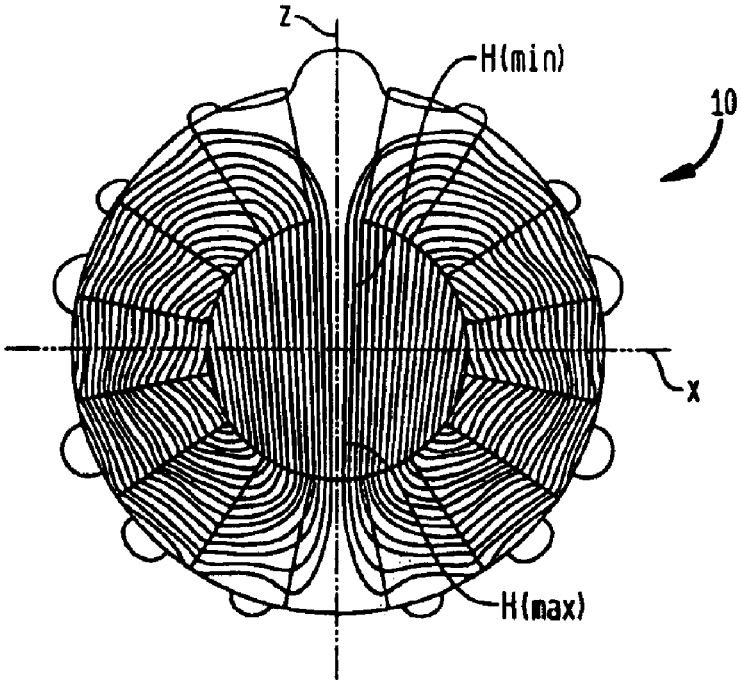
FIG. 11 is an end view of the cylindrical permanent magnet of FIG. 6 showing the lines of flux extending through a bore of the magnet.

Referring now also to FIGS. 10 and 11, after assembly of the permanent magnet 10, the permanent magnet may have a resultant magnetic field remanence (represented by arrows 32) that includes a general null at the notch 30 and an increasing field strength (H) along a z axis through cavity 16. As shown, H(min) represents a minimum field strength within the cavity 16 while H(max) represents a maximum field strength.

Figure 12:
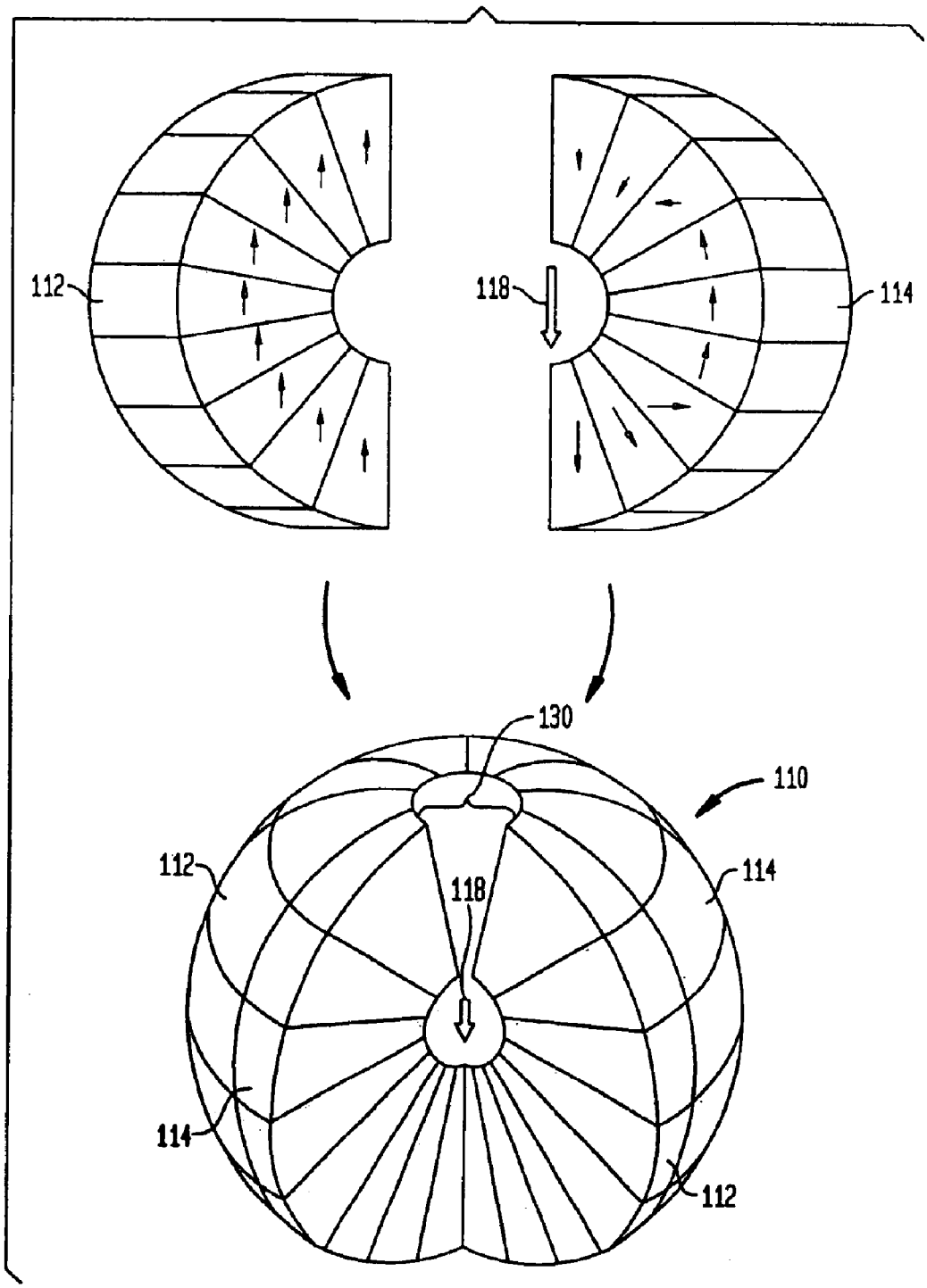
FIG. 12 is an exploded view showing assembly of a spherical permanent magnet in accordance with another embodiment of the present invention.

Another embodiment of a permanent magnet in accordance with the present invention is illustrated generally at 110 in FIG. 12. The permanent magnet 110 may be similar to permanent magnet 10 in many aspects except that, instead of a generally cylindrical configuration, the permanent magnet 110 comprises a generally spherical configuration. Accordingly, similar components are labeled with similar reference numbers excepting that a one is included in the reference number for those referring to permanent magnet 110.

The permanent magnet 110 comprises segments 112 and 114 each of which comprise a magnetic remanence $B_{r1}$ and $B_{r2}$ (represented by arrows 122, 128, respectively) which may be similar to that described above in connection with FIGS. 2 and 3. Therefore, reference may be had above to segments 12 and 14 for further details concerning segments 112 and 114.

Segments 112 and 114 may be cut from spherical blanks (not shown) which have been magnetized appropriately, as described above, and then assembled together by interleaving the segments 112 and 114 as shown. Also, the segments 112 and 114 may comprise a notch 130 that may be formed, e.g., prior to assembly thereof.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. A permanent magnet, comprising:

a shell surrounding a cavity and the shell comprising a magnetic remanence $B_r(\theta)$ configured whereby a magnetic field taper extends through the cavity and wherein the shell also comprises a non-distortive access region that is substantially absent any magnetic field.

2. The permanent magnet of claim 1, wherein the remanence $B_r(\theta)$ of the shell varies according to the formula:

$$B_r(\theta)=[(B_r^X(\theta))^2+(B_r^Z(\theta))^2]^{1/2}$$

where:

$B_r^X(\theta)=\{[(B_r^{Max}-B_r^{Min}\}/90°](\theta)-B_r^{Min}\cos(90°-2\theta)$;

$B_r^Z(\theta)=\{[(B_r^{Max}-B_r^{Min})/90°](\theta)-B_r^{Min}\}\sin(90°-2\theta)-B_r^{Min}$;

$(\theta)$ is a polar angle between $\theta=0°$ to $\theta=\pm180°$;

$B_r^{Max}$ is a maximum remanence desired;

$B_r^{Min}$ is equal to a minimum remanence appropriate to produce a minimum magnetic field H(Min) of the magnetic field taper.

3. The permanent magnet of claim 2, wherein the shell comprises a cylindrical configuration and the cavity also comprises a cylindrical configuration.

4. The permanent magnet of claim 2, wherein the shell comprises a spherical configuration and the cavity also comprises a spherical configuration.

5. A permanent magnet, comprising:

a shell surrounding a cavity and the shell comprising a magnetic remanence configured whereby a magnetic field taper extends through the cavity and the remanence $B_r(\theta)$ of the shell varying according to the formula:

$$B_r(\theta)=[(B_r^X(\theta))^2+(B_r^Z(\theta))^2]^{1/2}$$

where:

$B_r^X(\theta)=\{[(B_r^{Max}-B_r^{Min})/90°](\theta)-B_r^{Min}\}\cos(90°-2\theta)$;

$B_r^Z(\theta)=\{[(B_r^{Max}-B_r^{Min})/90°](\theta)-B_r^{Min}\}\sin(90°-2\theta)+(B_r^{Max}+B_r^{Min})/2$;

$(\theta)$ is a polar angle between $\theta=0°$ to $\theta=\pm180°$;

$B_r^X$ is a maximum remanence desired; and $B_r^{Min}$ is equal to a minimum remanence appropriate to produce a minimum magnetic field H(Min) of the magnetic field taper;

wherein the shell also comprises a pair of opposing non-distortive access regions substantially absent any magnetic field.

6. The permanent magnet of claim 5, wherein the shell comprises a cylindrical configuration and the cavity also comprises a cylindrical configuration.

7. The permanent magnet of claim 5, wherein the shell comprises a spherical configuration and the cavity also comprises a spherical configuration.

8. A method of making a permanent magnet having a cavity, comprising:

providing at least one first segment having a first magnetic field that has a single predetermined direction of magnetization and that has a uniform first remanence;

providing at least one second segment having a second magnetic field that has a direction of magnetization ($\gamma$) that varies circumferentially along the segment according to the formula $\gamma=(2)(\theta)$ where $\theta$ is a polar angle from $\theta=0°$ to $\theta=360°$ and wherein the second magnetic field comprises a second remanence which increases in magnitude from $\theta=0°$ to $\theta=180°$ and decreases in magnitude from $\theta=180°$ to $\theta=360°$; and combining the at least one first segment and the at least one second segment to form a permanent magnet.

9. The method of claim 8, wherein the single predetermined direction of magnetization is directly opposed to $\gamma$ at $\theta=0°$ and at $\theta=180°$.

10. The method of claim 8, wherein the second remanence ($B_{r2}$) of the second segment varies according to the formula $B_{r2}(\theta)=m\theta+B_{r1}$ where $\theta$ is a polar angle from $\theta=0°$ to $\theta=360°$; $m=(B_r^{Max}-B_r^{Min})/90°$; $B_r^{Max}$ is the maximum remanence desired and $B_r^{Min}$ is equal to $B_{r1}$ which is the uniform first remanence of the first segment.

11. The method of claim 8, wherein providing the at least one first segment comprises providing a plurality of first segments.

12. The method of claim 11, wherein providing the at least one second segment comprises providing a plurality of second segments.

13. The method of claim 12, wherein combining the at least one first segment and the at least one second segment comprises interleaving the plurality of first segments with the plurality of second segments to form an elongated structure.

14. The method of claim 13, wherein providing a plurality of first segments comprises uniformly magnetizing a cylindrical shell and cutting the shell into thin washer-shaped pieces.

15. The method of claim 14, wherein providing a plurality of second segments comprises:

magnetizing a cylindrical shell with a magnetic field having a direction of magnetization ($\gamma$) varies circumferentially along the segment according to the formula $\gamma=(2)(\theta)$ where $\theta$ is a polar angle from $\theta=0°$ to $\theta=360°$ and a gradient which varies according to the formula $B_{r2}(\theta)=m\theta+B_r^{Min}$ where $\theta$ is a polar angle from $\theta=0°$ to $\theta=360°$; $m=(B_r^{Max}-B_r^{Max})/90°$; $B_r^{Max}$ is the maximum remanence desired and $B_r^{Min}$ is equal to $B_{r1}$ which is the uniform first remanence of the first segment cutting the shell into a plurality of thin magnetic ring slices.

16. The method of claim 15, wherein interleaving the plurality of first segments and the plurality of second segments comprises interleaving the washer shaped pieces with the magnetic ring slices to form the elongated structure.

17. The method of claim 8, wherein the permanent magnet comprises a cylindrical configuration and includes a cylindrical cavity.

18. The method of claim 8, wherein the permanent magnet comprises a sphere having a spherical cavity.

19. A permanent magnet having a cavity, comprising:

at least one first segment comprising a first magnetic field that is aligned in a single predetermined direction of magnetization and that has a uniform first remanence; and at least one second segment comprising a second magnetic field that has a direction of magnetization ($\gamma$) that varies circumferentially along the segment according to the formula $\gamma=(2)(\theta)$ where $\theta$ is a polar angle from $\theta=0°$ to $\theta=360°$ and wherein the second magnetic field comprises a second remanence which increases from $\theta=0°$ to $\theta=180°$ and decreases from $\theta=180°$ to $\theta=360°$;

wherein the at least one first segment and the at least one second segment are combined to form a permanent magnet.

20. The permanent magnet of claim 19, wherein the single predetermined direction of magnetization is directly opposed to $\gamma$ at $\theta=0°$ and at $\theta=180°$.

21. The permanent magnet of claim 20, wherein the second remanence ($B_{r2}$) of the second segment varies according to the formula $B_{r2}(\theta)=m\theta+B_r^{Min}$ where $\theta$ is a polar angle from $\theta=0°$ to $\theta=360°$; $m=(B_r^{Max-B_rMin})/90°$; $B_r^{Max}$ is the maximum remanence desired and $B_r^{Min}$ is equal to $B_{r1}$ which is the uniform first remanence of the first segment.

22. The permanent magnet of claim 19, wherein the at least one first segment comprises a plurality of first segments.

23. The permanent magnet of claim 22, wherein the at least one second segment comprises a plurality of second segments.

24. The permanent magnet of claim 23, wherein the at least one first segment is joined directly adjacent the at least one second segment.

25. The permanent magnet of claim 19, wherein the plurality of first segments and the plurality of second segments each comprise a cylindrical configuration and each include a cylindrical cavity.

26. The permanent magnet of claim 19, wherein the plurality of first segments and the plurality of second segments each comprise a portion of a sphere and each include a portion of a spherical cavity.

* * * * *